US006390260B1

(12) United States Patent
Roegner

(10) Patent No.: US 6,390,260 B1
(45) Date of Patent: May 21, 2002

(54) BABY CARRYING CASE AND TRAVELING BED

(76) Inventor: DeAnna Roegner, 774 Mays Blvd., #10-405, Incline Village, NV (US) 89451

( * ) Notice: Subject to any disclaimer, the term of this patent is extended or adjusted under 35 U.S.C. 154(b) by 0 days.

(21) Appl. No.: 09/432,369

(22) Filed: Nov. 3, 1999

(51) Int. Cl.[7] ..... A45C 9/00; A45C 3/00

(52) U.S. Cl. ..... 190/109; 190/1; 190/2; 190/8; 190/12 A; 383/4

(58) Field of Search ..... 190/1, 2, 109, 190/8, 12 A; 383/4; 5/414; D3/42

(56) References Cited

U.S. PATENT DOCUMENTS

| | | | | | |
|---|---|---|---|---|---|
| 2,044,717 | A | * | 6/1936 | McElmoyl | 190/8 |
| 2,177,624 | A | * | 10/1939 | Marks | 150/114 X |
| 2,540,165 | A | * | 2/1951 | Fiel | 383/4 |
| 2,612,199 | A | * | 9/1952 | Schocket | 150/119 X |
| 2,697,465 | A | * | 12/1954 | Johnson | 383/4 X |
| 4,273,221 | A | * | 6/1981 | Poag | 190/8 |
| 4,535,878 | A | * | 8/1985 | Grahl | 190/1 |
| 4,620,579 | A | * | 11/1986 | Lowe et al. | 150/112 |
| D288,146 | S | * | 2/1987 | Cathcart et al. | D3/42 |
| 4,739,809 | A | * | 4/1988 | Adams | 150/112 |
| 4,953,765 | A | * | 9/1990 | Little et al. | 383/4 X |
| 5,070,973 | A | * | 12/1991 | Barnicoat | 190/8 |
| 5,160,001 | A | * | 11/1992 | Marceau | 190/102 |
| 5,649,658 | A | * | 7/1997 | Hoffman et al. | 224/576 |
| 5,785,427 | A | * | 7/1998 | Godshaw | 383/4 X |
| 5,941,437 | A | * | 8/1999 | Okumura | 383/4 X |
| 6,039,474 | A | * | 3/2000 | DeChant | 383/66 |

* cited by examiner

*Primary Examiner*—Allan N. Shoap
*Assistant Examiner*—Tri M. Mai
(74) *Attorney, Agent, or Firm*—Freling Baker; Baker & Eddy

(57) ABSTRACT

A baby bag carrying case comprises a shell of pliable material, the shell formed of a rectangular back panel, a rectangular front panel, a rectangular bottom panel, and two side panels secured along the periphery or common side edges of the back panel and the front panel thereby forming at least one receptacle having a top opening, a foldable top closure panel secured along an edge to a top edge of the back panel and foldable over the top and down and detachably secureable to the front panel, the foldable closure panel configured to overlap and close the open top of the receptacle and plurality of pockets for securing articles contained within, and an elongated rectangular padded panel secured along an end edge to a lower edge of said front panel the padded panel having a width about equal to that of the front panel and a length about twice the length of the front panel, a collapsible side wall panel secured along each side edge of the padded panel, the side wall panels having a generally triangular configuration, and detachable securing means along a front edge for detachably securing to said front panel for securing the side wall panels in an upright position side wall.

22 Claims, 7 Drawing Sheets

BABY CARRYING CASE AND TRAVELING BED

BACKGROUND OF THE INVENTION

The present invention relates to a carrying case and, more particularly to a combination of a baby bag or carrying case and traveling bed having several pocket assemblies, compartments and a folding panels for organizing and storing various baby needs.

Mothers with babies must often carry many items for care of the baby when away from home, whether going on short or long trips, the items are often placed loosely in one or more carrying bags. Caring for a baby requires the use of many and various items including many changes of clothing, feeding materials and paraphanilla and amusement items. The clothing needs include many changes of diapers, diapers, wipes, ointments and powders. The feeding needs of a baby require various items of food including formula, milk, water and bottles or cans of food. Various toys and playthings are also necessary to keep the baby occupied when necessary. Additionally, the mother often takes a small blanket and seat cushion for personal comfort that are carried in a separate carrying bag that frequently become misplaced or forgotten. It is cumbersome to carry several bags containing all of these items, and is difficult to easily locate a particular item mixed in with all of the other baby accessories.

Accordingly it is desirable that there be available a baby bag carrying case that provides ample storage pockets and retaining members for carrying numerous assorted items in a single bag when traveling with the baby.

There is a need for a baby carrying case designed for organizing and storing baby accessories having both interior and exterior pockets for storing baby items and receptacles for storing a baby's blanket and other items that are often needed. It would be desirable to have a case with multiple pockets for holding these multiple items of different sizes in a secure manner and providing ease of accessibility.

SUMMARY AND OBJECTS OF THE INVENTION

It is the primary object of the present invention to provide a baby bag carrying case with multiple pockets for holding items of different sizes in a secure and readily accessible manner.

It is another object of the present invention to provide a baby bag carrying case with a cushion-padded back panel design forming combined changing station and shaded travel bed.

A carrying case for baby accessories, comprises a shell of pliable material, the shell formed of a rectangular back panel, a rectangular front panel, a rectangular bottom panel, and two side panels secured along the periphery or common side edges of the back panel and the front panel thereby forming at least one receptacle having a top opening, a foldable top closure panel secured along an edge to a top edge of the back panel and foldable over the top and down and detachably secureable to the front panel, the foldable closure panel configured to overlap and close the open top of the receptacle and plurality of pockets for securing articles contained within, an elongated rectangular padded panel secured along an end edge to a lower edge of said front panel the padded panel having a width about equal to that of the front panel and a length about twice the length of the front panel, a collapsible side wall panel secured along each side edge of the padded panel, the side wall panels having a generally triangular configuration, and detachable securing means along a front edge for detachably securing to said front panel for securing the side wall panels in an upright position side wall.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 1:
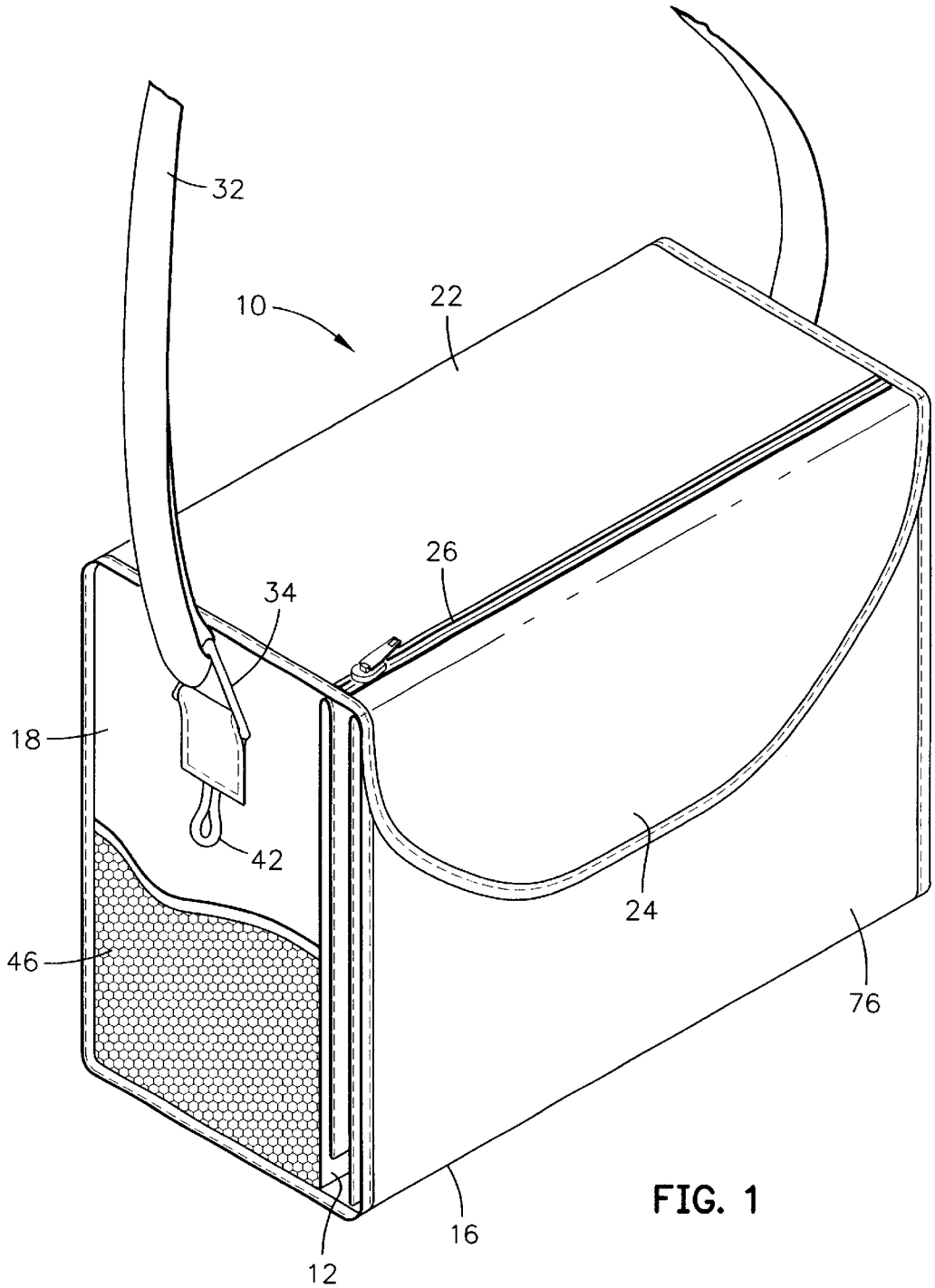
FIG. 1 is a perspective view of an exemplary preferred embodiment of the invention with the baby bag carrying case closed.

Referring to FIGS. 1 through 8 of the drawing, an exemplary embodiment of a hand carried case in accordance with the invention is illustrated and designated generally by the numeral 10. The case is preferably constructed of a pliable material such as leather, vinyl, nylon, or any of the suitable woven materials now widely used for handbags, purses, suit cases and the like. In a preferred construction, the baby bag outer shell construction may be made of a fabric covered with a waterproof material having at least six mil thickness. Each of the front and back panels and the bottom panel forming the shell preferably has padding such as quarter inch foam padding as a backing material so that the baby bag case absorbs shock if accidentally dropped.

Referring to FIG. 1, the baby bag carrying case comprises a primary shell formed of a pair of front and back generally rectangular panels 12 and 14, secured along bottom and side edges to a bottom panel 16 and side panels 18 and 20 forming a generally rectangular box-like receptacle. The front, back and bottom panels can be formed of one continuous panel with the side panels being separate panels. Likewise, the bottom and side panels may be one continuous panel with the front and back panels being separate. The front, side and back panels optionally can include a stiffener such as foam, cardboard or the like sandwiched between opposing faces of a multi-layered pliable fabric panel to maintain the shape of the case to enable it so sit upright. Alternatively, a seam construction of the outer edges of the case enclosure can provide the desired stiffening of the case without need for a stiffener attached to the outer front and back panels 12 and 14. In a preferred embodiment, the front panel, back panel, bottom panel and side panels contain a foam padding to protect the contents of the bag, and also add some stiffness.

A closure panel 22 extends from the top edge of the back 14 either as a continuation thereof or as a separate panel secured thereto. The closure panel is formed with a rectangular panel portion which is adapted to extend over and cover the top opening of the case. A forward or front flap extension 24 extends from a forward edge of the rectangular top panel and has a generally curved or semicircular configuration for extending down the front of the front panel for detachable attachment thereto. A hook and loop fastener 28 on the flap (FIG. 5) engages a hook and loop fastener tab 30 on the front panel (FIG. 3) to secure the closure in the closed position. The top or closure panel 22 is formed with an envelope type pocket having a closure such as a zipper 30 extending along one edge thereof. This pocket is convenient for securing personal items and preferably includes a waist pack to be described.

Figure 3:
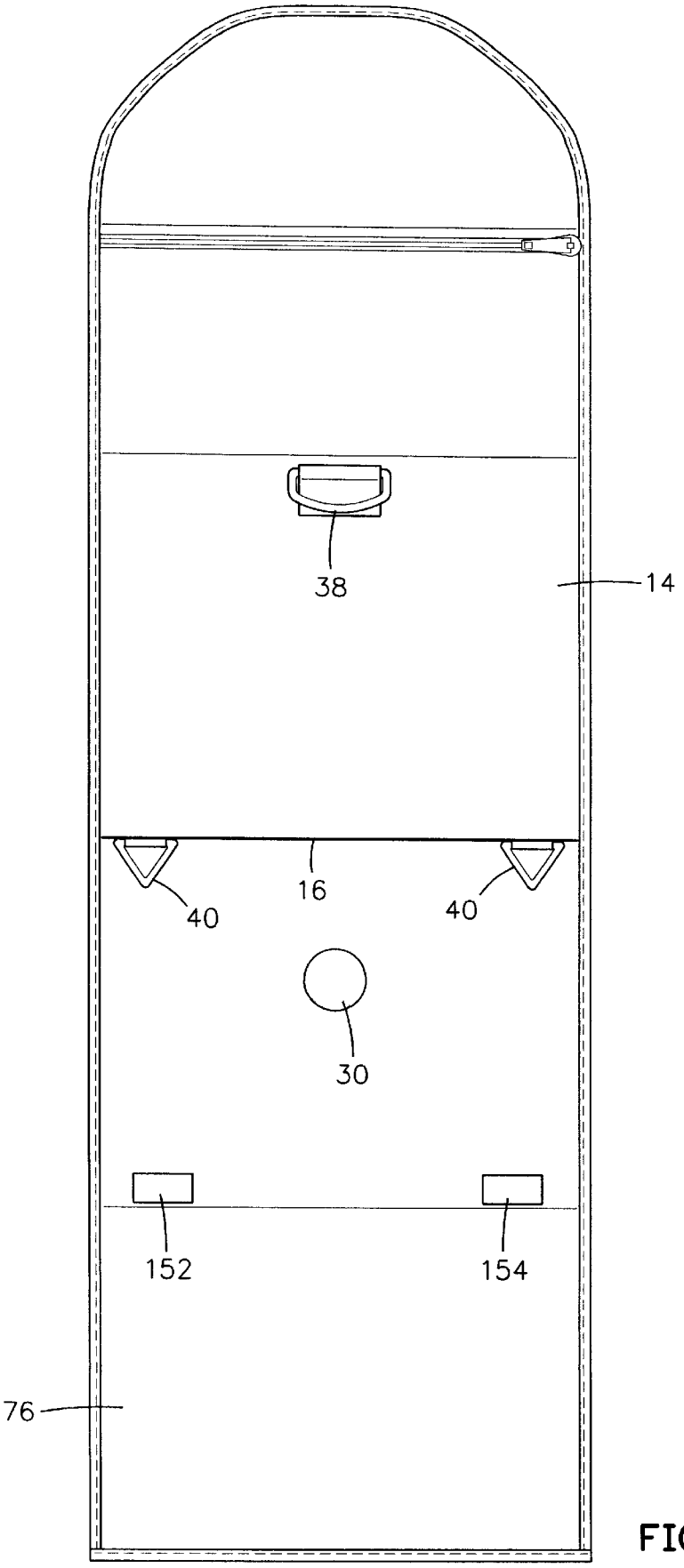
FIG. 3 is a elevation view of the obverse side of the baby bag carrying case as shown in FIG. 2 open and the changing station/traveling bed extended.

A carrying strap 32 is secured through d-rings 34 and 36 at the top of side panels 18 and 20 and provides a handle or shoulder strap mode or configuration. It also converts from the shoulder strap to a handle and to back pack modes or configurations. The back pack mode is enabled by a D-ring 38 at the top center of the back panel and a pair of D-rings 40 secured to the bottom edge of the back panel 14 (FIG. 3). A pair of loops 42 and 44 (FIG. 5) secured under the D-rings 34 and 36 on the exterior of the side panels provide for the detachable attachment of a binky leash or keys.

Figure 4:
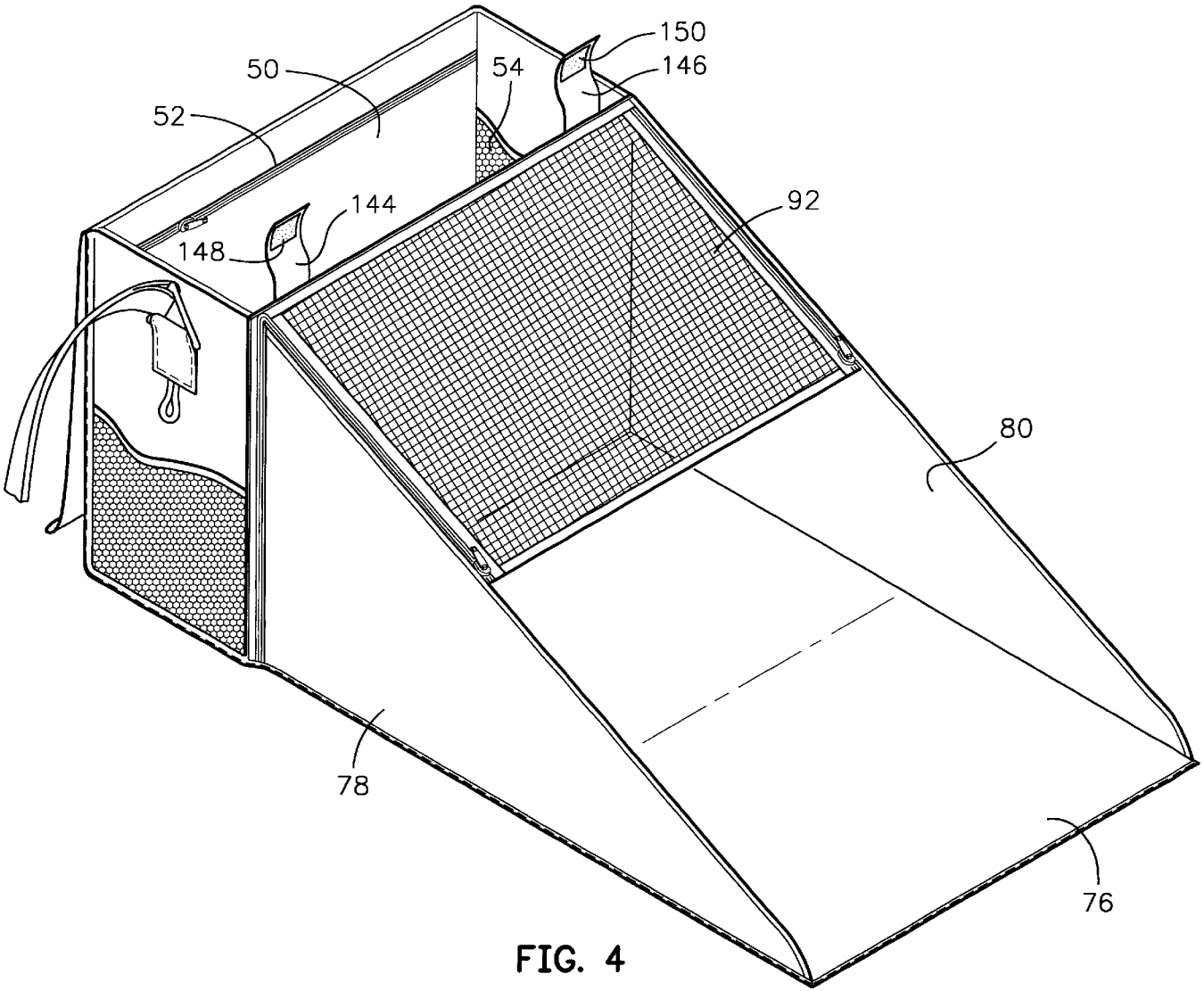
FIG. 4 is a perspective view of the invention shown in FIG. 3 with the baby bag carrying case closure in the open position and the changing station/traveling bed extended with draft protection side walls and shade in position.
Figure 5:
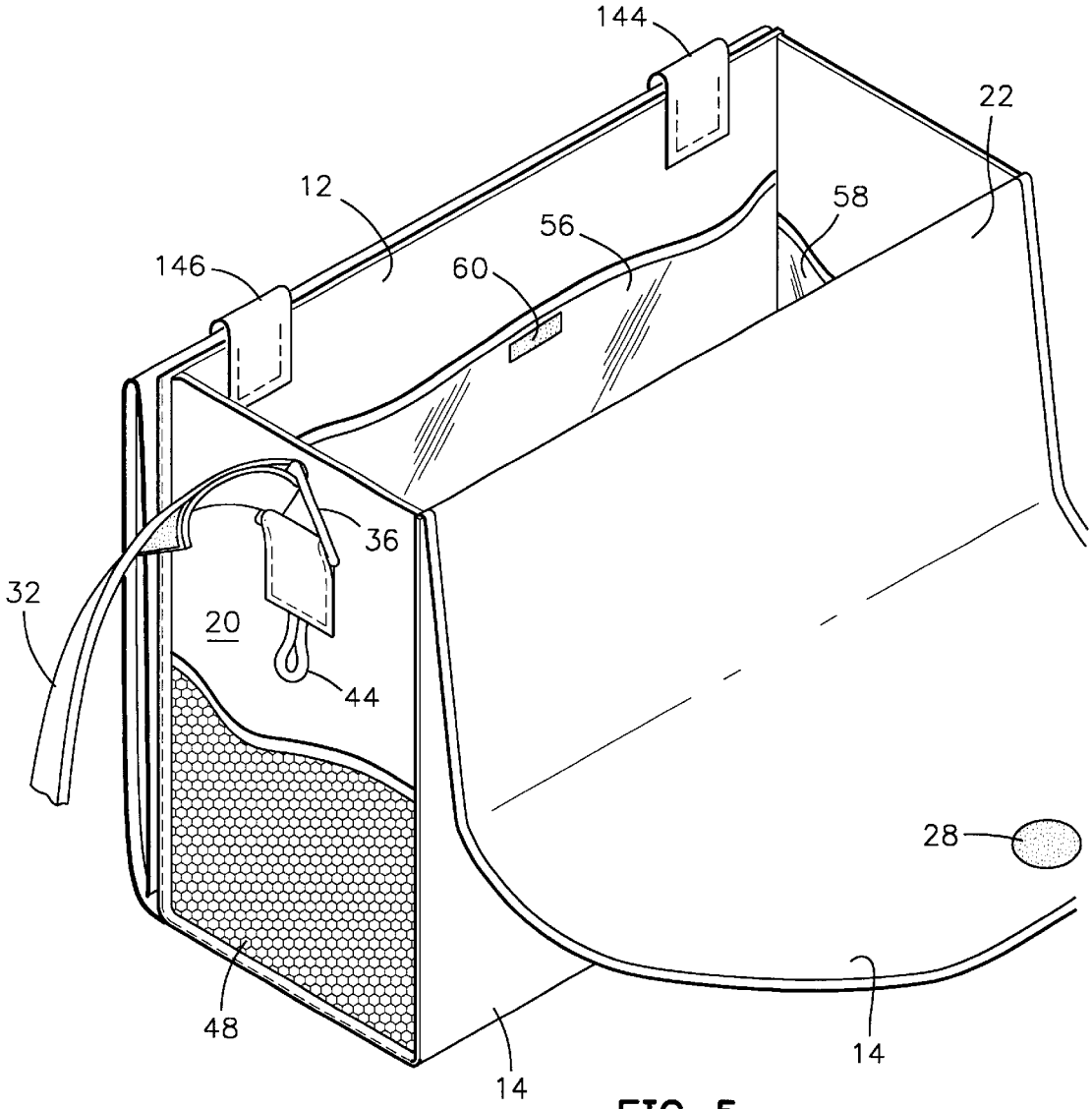
FIG. 5 is a perspective view of the baby bag carrying case with the closure open and showing interior pockets and exterior mesh pocket.

A pair of open mesh pockets 46 and 48 are formed on or secured to the outside of the end panels 18 and 20 (FIGS. 1 and 5). The interior of the case is formed with a large envelope type pocket 50 with a zipper closure 52 on the interior of the back wall (FIG. 4) for stowage of clothing. An open mesh pocket 54 on is also formed on an interior of a side wall(FIG. 4) to serve as a hamper. The interior of the case is also formed with a first transparent panel pocket 56 on the interior of the front wall panel (FIG. 5) and a second open transparent panel pocket 58 on an interior of the second side wall (FIG. 5). A hook and loop fastener 60 is adapted to secure the pocket 56 in the closed position.

Figure 2:
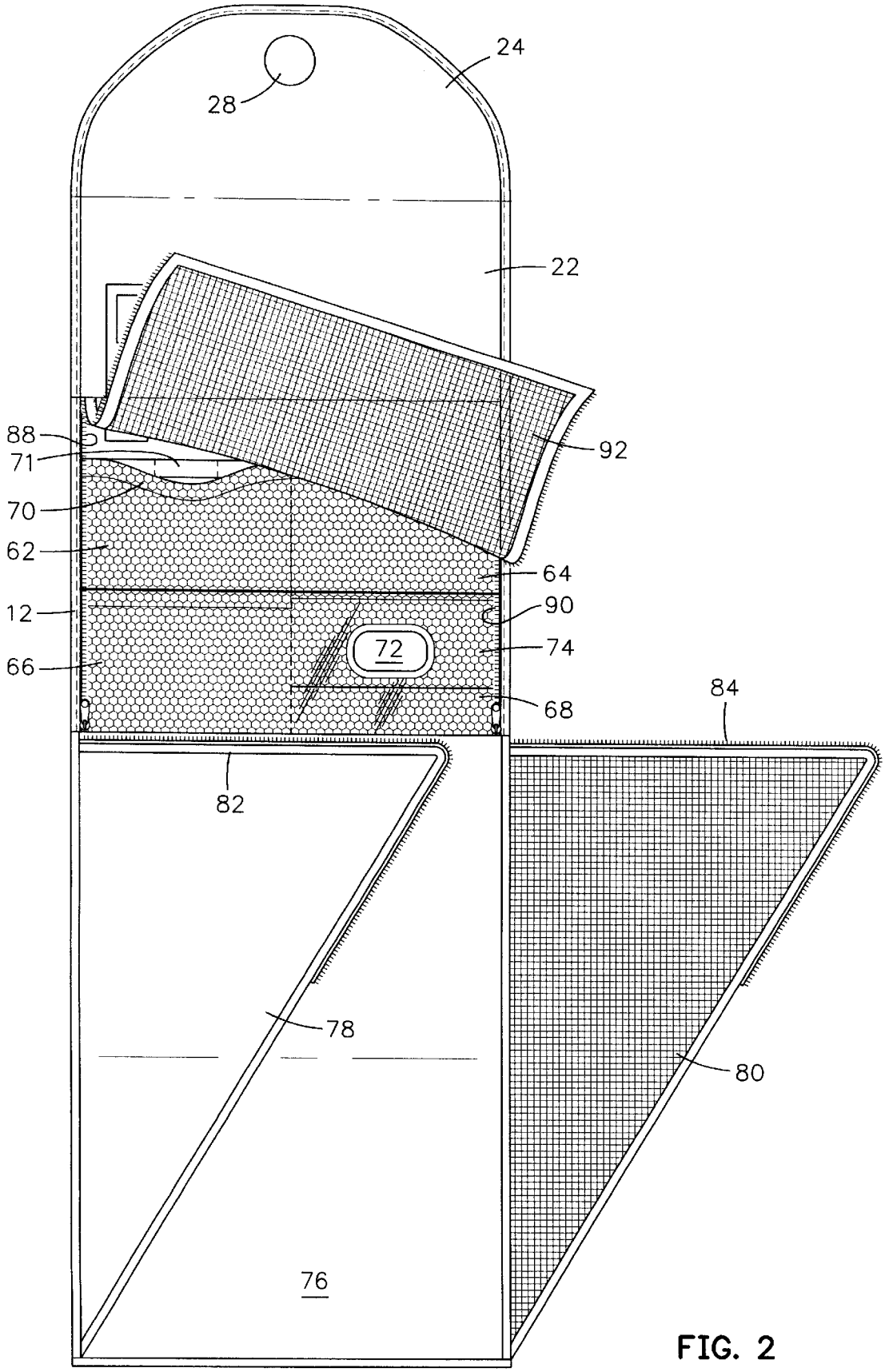
FIG. 2 is a front elevation view of the embodiment of FIG. 1 with the baby bag carrying case as shown in FIG. 1 when open and the changing station/traveling bed extended.

Referring to FIGS. 2 and 3, at least one mesh-type pocket assembly of four pockets 62, 64, 66 and 68 is preferably made of a web, netting or mesh-type material with or without a securable foldable flap using a hook and loop fastener and has a bottom transverse edge common with the front panel. The upper edge of each pocket is preferably formed with an elastic strap or band as shown at 70 for elastically closing the pocket. At least the two top pockets on the front pocket assembly has an elongated elastic strap 71 secured at multiple points inside the top edge of the pockets so as to form a plurality of loops for retaining articles of specified size and shape. The pockets are adapted to hold and provide easy access to bottles, toys and wipes. As shown, this pocket assembly provides ease of viewing and identifying articles contained within the various pockets. The front panel may have any number of the pocket assemblies comparable to the illustrated assembly for holding any number and kind of small articles (for example a mug retaining pocket).

At least one pocket 68 of the front pocket assembly is lined with a transparent waterproof material such as vinyl in order to hold moistened wipes. This pocket is also provided with small oval opening 72 through the front panel thereof and provided with a transparent flap cover 74 to cover the oval opening. This opening enables one to pull individual wipes through the opening from the interior of the pocket thereof. These pockets are handy to the bed and changing pad or area to be described. The pockets each has a stretch or elastic band top edge to pull the pocket closed and provides easy access to bottles, toys and wipes.

The overall baby bag carrying case is constructed with a at least a panel forming a changing station that converts to or serves as a shaded travel bed. This station is formed by an elongated generally rectangular bed or mattress panel or pad 76 which is preferably padded and secured along one end to the bottom of the front panel 12. This panel extends outward from the front panel for use and may be stowed by folding and securing it against the front panel of the bag, as seen in FIG. 1. The panel serves as a bed or mattress and is preferably formed by a foam pad of about one-half inch thick covered on opposite sides by easily wiped clean fabric panels. The bed panel is preferably about the same width as the carrying case and has a length about twice the length or height of the case or front panel of the case. The case is preferably about fourteen inches wide and about twelve inches high. This provides a bed panel of about fourteen by twenty four inches. Thus, the panel can fold in half against the front panel and be secured thereto by suitable means such as hook and loop fasteners for stowage.

A pair of triangular shaped shield panels 78 and 80 are secured along the side edges of the bed panel and are detachably securable at a front vertical edge to the vertical side edges of the front panel by suitable means to hold them in a shielding upright position. The shield panels are each provided with zipper strips 82 and 84 along one edge to match and connect with strips 88 and 90 on and extending along the side edges of the front panel of the bag onto and along side edges of a sun screen or shade 92. The zippers detachably secures the shield panels to the front panel and to the edges of the shade panel as shown in FIG. 4. Other securing means such as hook and loop or snap fasteners may be used in place of the zipper.

These shield panels are preferably triangular in shape sloping from a minimum height at the outer end to a maximum height at the front panel. The shield panels fold down on top of the bed panel and fold therewith against the front panel of the bag for stowage. In the preferred construction, the panels have an outer fabric cover sheet over a web like interior sheet or panel and may also include stiffening panels or construction. The shade panel 92 is secured along one edge to the upper edge of the front panel and extends outward along the top edges of the shield panels to provide a sun shade and some support for the shield panels. A zipper detachably secures the shield panels to the front panel and along and to the side edges of the shadepanel.

Figure 6:
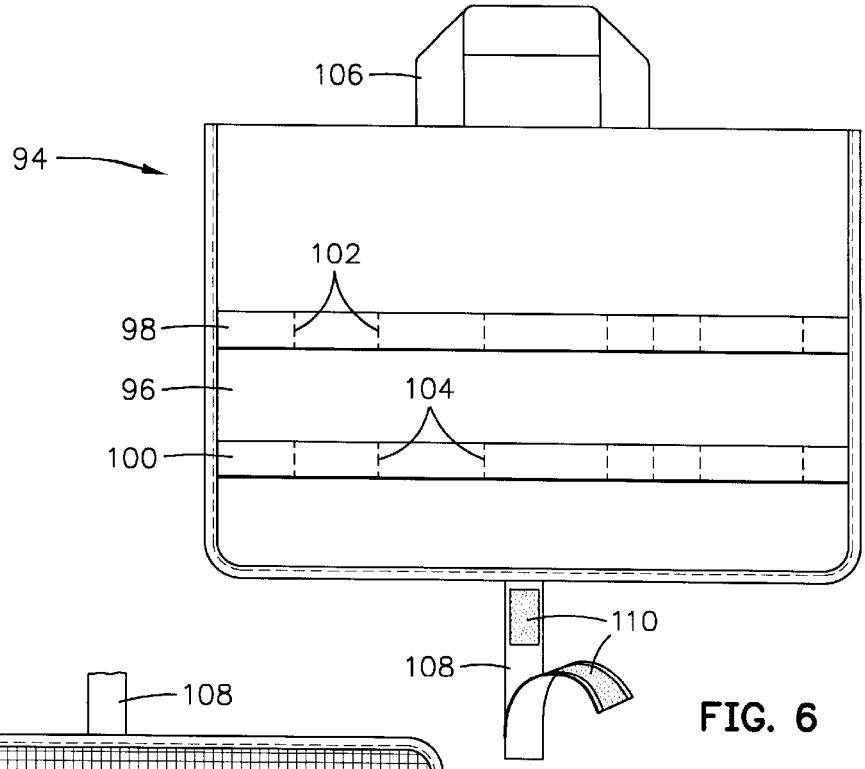
FIG. 6 is an elevation view of a removable baby organizer configured for storing bottles, formula, food and snacks in the receptacle of the baby bag carrying case.
Figure 7:
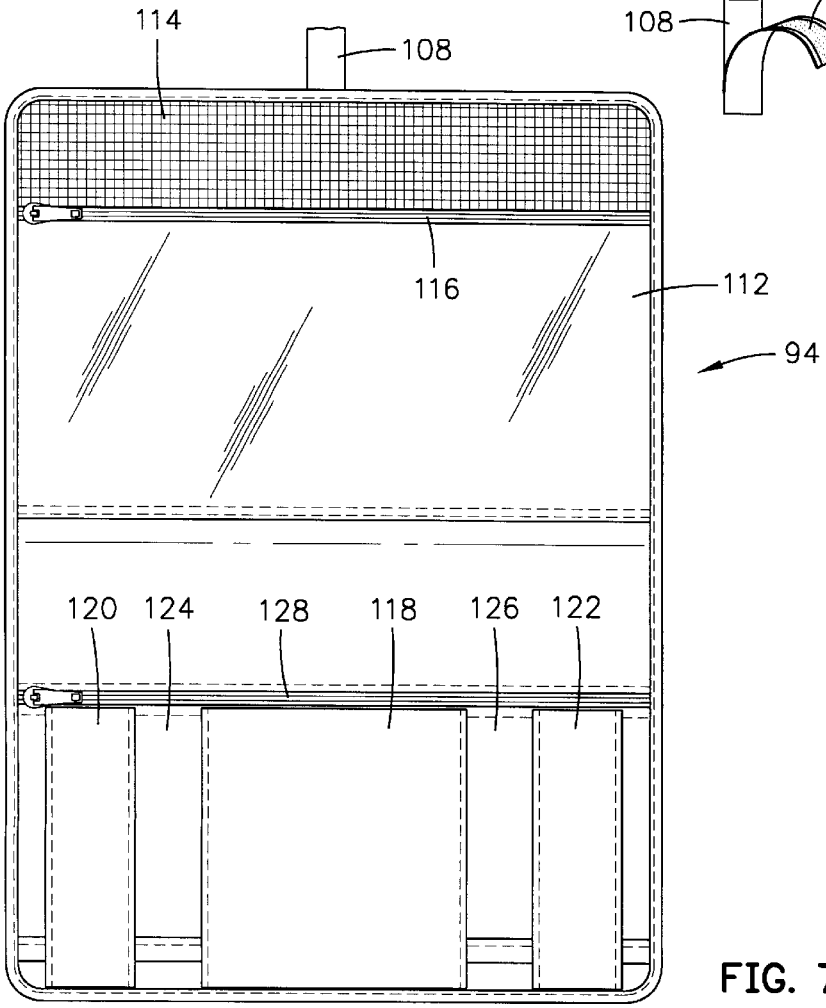
FIG. 7 is an elevation view of the removable baby organizer of FIG. 6, in the open position showing the pockets configured for storing bottles, formula, food and snacks in the receptacle of the baby bag carrying case.

Referring to FIGS. 6 and 7, a bi-folded multi-pocket removeable accessory assembly is illustrated and generally designated as numeral 94 that comprises disparate pocket assemblies attached to a back panel that folds along a folding line and has a fold over upper pocket panel 96. The outer surface of the accessory assembly includes a pair of elastic straps 98 and 100 that are secured at spaced positions such as by stitching at multiple e.g., 102 and 104 to form a plurality of elastic retaining loops for holding small articles (for example, pens, pencils, baby bugles, lighters and clothes pins). These multiple loops have limited elasticity to allow ease of securing to or obtaining from the case any small article secured thereto. These multiple loops are selectively secured at locations so as to form fit a particular desired small article.

A strap 106 is secured to the center of the back panel where it folds to form a carrying handle. A second strap 108 is secured to the edge (top) of the panel and includes hook and loop fasteners 110 to enable securing it over hanging bar or the like. As shown in FIG. 7, the accessory pocket assembly has a large upper pocket 112 which is formed of a transparent front panel secured along bottom and two sides to the back panel an includes an upper open mesh strip 114 between which an opening is formed.

The lower portion of the multi-pocket assembly includes, but is not limited to, a zigzag or pleated lower insulated pocket assembly having three primary insulated open top pockets including a large central pocket 118 and two side pockets 120 and 122. The pockets are formed of an overlapping insulated panel with pleated or zigzag accordion-like folds that form open top insulated pockets with folded sides between a front and the back panel. The pockets are formed such as by a continuous panel that is folded in the pleated or zigzag fashion as shown when the pockets are empty.

These pockets are formed by the panel which is folded so that the spaces 124 and 126 between them form open sided pockets. The excess material of each primary pocket permits expansion of the open top pockets and provides size, shape, and definition to each of the open sided pockets. These primary pockets are constructed with collapsed or folded sides such that when one of the pockets is partially filled, adjacent spaces between adjacent primary pockets form an open-sided pocket that is available for the placement of additional articles. However, the primary pockets are constructed so that they can be completely filled such that no additional space or open sided pockets exist between adjacent pockets. The preferred use of these pockets are for storage of multiple foods that require cooling. A pocket having a zippered closure 128 is formed behind the multiple pockets for containing an ice or cold pack to maintain items of food and the like in the multiple pockets in a cool state.

Figure 8:
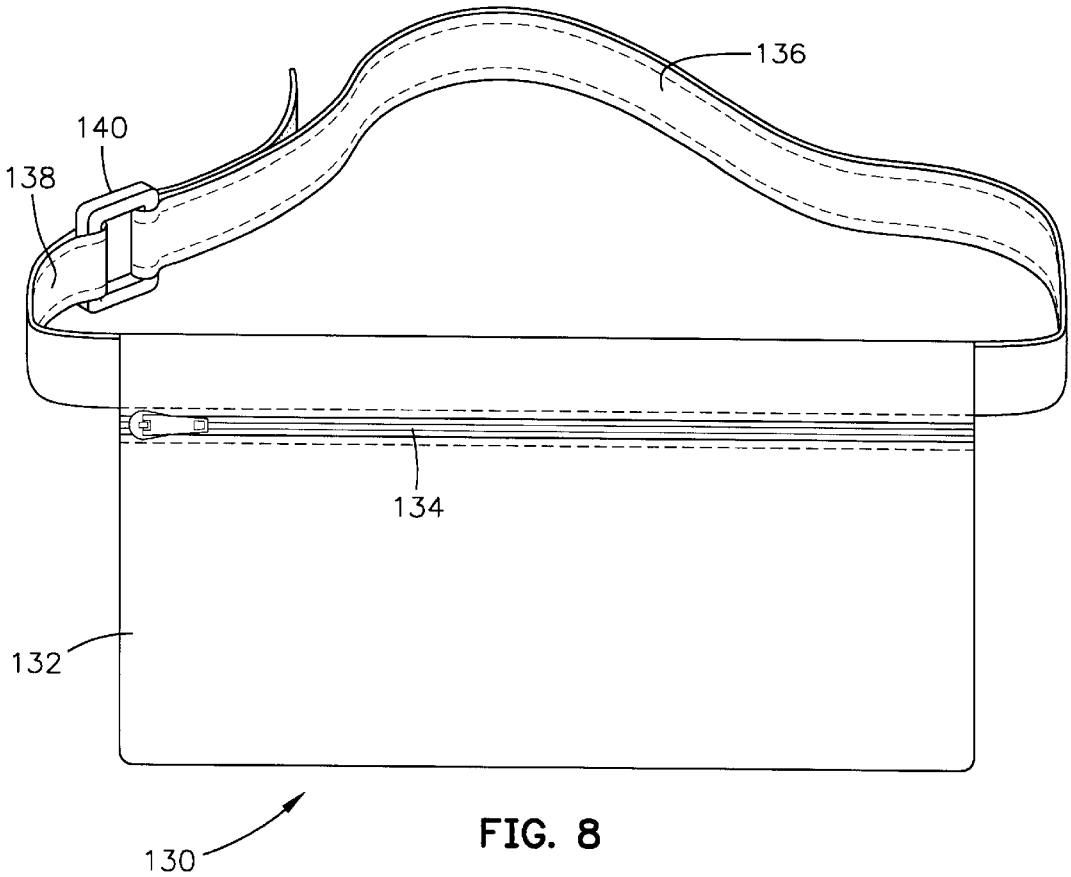
FIG. 8 is an elevation view of a waist pack configured the mother's use for carrying money and personal items.

Referring to FIG. 8, a waist pack designated generally at 130 is included in the baby bag. The waist pack comprises an envelope type bag 132 of a generally rectangular configuration formed of front and back panels secured together along the edges thereof and having an elongated slit opening with a zipper closure 134. A belt or waist strap is formed of a pair of straps 136 and 138, each secured at one end to an upper corner of the bag 132. One strap is looped through and attached to a D ring 140 in a fixed position. The other strap 136 loops through the D-ring and includes hook and loop fastening means to enable adjusting the belt or strap around a waist. This waist pack is conveniently stowed in the top pocket on the closure or cover of the baby bag carrying case.

The combination bed and changing station is easily folded and stowed against the front panel as shown in FIG. 1 with flap 24 extending down over the top portion thereof. The bed is held in place by a pair of straps 144 and 146 (FIG. 4), each having a hook and loop patch 148 and 150 which engage and secure to hook and loop patches 152 and 154 on the bottom of the mattress pad (FIG. 3). The carrying case in combination with the waist pack and organizer form kit for baby care needs.

While I have illustrated and described my invention by means of specific embodiments, it is to be understood that numerous changes and modifications may be made therein without departing from the spirit and the scope of the invention as shown in the appended claims.

I claim:

1. A carrying case for baby accessories, comprising:

a shell of pliable material, the shell formed of a generally rectangular back panel, front panel, bottom panel, and two side panels secured together along common side edges of the back panel and the front panel thereby forming at least one receptacle having a top opening;

an elongated rectangular padded panel secured along an end edge to a lower edge of said front panel and extendable outward defining an infants bed;

an generally rectangular screen panel secured along an end edge to an upper portion of said front panel and extendable outward to define a shade over said infants bed;

a front pocket panel on the outer surface of the front panel, the front pocket panel including a pocket panel section that forms a plurality pockets having an open top being generally shaped and configured to receive articles;

a foldable top closure panel secured along an edge to a top edge of the back panel and foldable over the top and down and detachably securable to the front of the receptacle; and the foldable closure panel configured to overlap and close the open top of the receptacle and plurality of pockets for securing articles contained within.

2. The carrying case of claim 1, wherein at least one of the pockets on the front pocket assembly is formed of open mesh panel.

3. The carrying case of claim 2, wherein at least one of the pockets on the front pocket assembly is formed of a transparent panel.

4. The carrying case of claim 1, wherein at least one of the pockets on the front pocket assembly has an elongated elastic strap secured at multiple points at the top front face so as to form a plurality of loops for retaining articles of specified size and shape.

5. The carrying case of claim 4, wherein at least two of the pockets on the front pocket assembly has an elongated elastic strap secured at multiple points at the top front face, wherein the straps are inside the top edge of the pockets.

6. The carrying case of claim 1, wherein a pocket panel is secured to an inner face of each of said front panel and said back panel forming interior storage pockets, and one of said pocket panels is transparent.

7. The carrying case of claim 1, wherein a pocket panel is secured to an outer surface of said closure panel forming exterior storage pocket.

8. The carrying case of claim 1, wherein the padded panel has a width about equal to that of the front panel and a length about twice the length of the front panel.

9. The carrying case of claim 1 further comprising a collapsible side wall panel secured along each side edge of the padded panel for supporting said screen panel in an outwardly extended position.

10. A carrying case for baby accessories, comprising:

a shell of pliable material, the shell formed of a generally rectangular back panel, front panel, bottom panel, and two side panels secured together along common side edges of the back panel and the front panel thereby forming at least one receptacle having a top opening;

an elongated rectangular padded panel having a width about equal to that of the front panel and a length about twice the length of the front panel secured along an end edge to a lower edge of said front panel and extendable outward defining an infants bed;

a collapsible side wall panel secured along each side edge of the padded panel wherein the side wall panels have a generally triangular configuration, further comprising detachable securing means along a front edge for detachably securing to said front panel for securing the side wall panels in an upright position;

a front pocket panel on the outer surface of the front panel, the front pocket panel including a pocket panel section that forms a plurality pockets having an open top being generally shaped and configured to receive articles;

a foldable top closure panel secured along an edge to a top edge of the back panel and foldable over the top and down and detachably securable to the front of the receptacle; and the foldable closure panel configured to overlap and close the open top of the receptacle and plurality of pockets for securing articles contained within.

11. The carrying case of claim 10 further comprising, an open mesh cover panel secured at a top of the front panel for covering the front area of the padded panel.

12. The carrying case of claim 11, wherein at least one of the pockets on the front pocket assembly is formed of open mesh panel.

13. The carrying case of claim 12, wherein at least one of the pockets on the front pocket assembly is formed of a transparent panel.

14. The carrying case of claim 13, wherein at least one of the pockets on the front pocket assembly has an elongated elastic strap secured at multiple points at the top front face so as to form a plurality of loops for retaining articles of specified size and shape.

15. The carrying case of claim 14, wherein at two of the pockets on the front pocket assembly has an elongated elastic strap secured at multiple points at the top front face, wherein the straps are inside the top edge of the pockets.

16. The carrying case of claim 15, wherein a pocket panel is secured to an inner face of each of said front panel and said back panel forming interior storage pockets, and one of said pocket panels is transparent.

17. The multi-pocket assembly of claim 10, further comprising the combination of a removable multi-pocket assembly, the multi-pocket assembly comprising:

a generally rectangular foldable back panel having an inner surface and an outer surface, the back panel foldable along a transverse line to define an upper panel and a lower panel;

an upper pocket assembly on the inner surface of said upper panel;

a lower pocket assembly on the inner surface of said lower panel, the lower pocket assembly including a pleated pocket section that forms a plurality pockets having an open top being generally the same length and shaped and configured to receive articles; and a plurality of elastic retaining loops on the outer surface of said back panel; wherein said upper panel foldable over said lower panel.

18. A carrying case for baby accessories, comprising:

a shell of pliable material, the shell formed of a rectangular back panel, a rectangular front panel, a rectangular bottom panel, and two side panels secured along the periphery of common side edges of the back panel and the front panel thereby forming at least one receptacle having a top opening;

a foldable top closure panel secured along an edge to a top edge of the back panel and foldable over the top and down and detachably securable to the front panel, the foldable closure panel configured to overlap and close the open top of the receptacle and plurality of pockets for securing articles contained within; and an elongated rectangular padded panel secured along an end edge to a lower edge of said front panel the padded panel having a width about equal to that of the front panel and a length about twice the length of the front panel surface defining an infants bed and foldable against said front panel for stowage;

a collapsible side wall panel secured along each side edge of the padded panel, the side wall panels having a generally triangular configuration; and detachable securing means along a front edge of each side wall panel for detachably securing to said front panel for securing the sidewall panels in an upright position.

19. The carrying case of claim 18 further comprising an open mesh cover panel secured at a top of the front panel for covering the front area of the padded panel.

20. The carrying case of claim 19 further comprising a front pocket panel, the front pocket panel including a pocket panel section that forms a plurality pockets having an open top being generally the same length and shaped and configured to receive articles, wherein at least one of the pockets on the front pocket assembly is formed of open mesh panel; and wherein at least one of the pockets on the front pocket assembly has an elongated elastic strap secured at multiple points inside the top edge of the pocket at the top front face.

21. The multi-pocket assembly of claim 18, further comprising a pair of side wall panels have a generally triangular configuration, and detachable securing means along a front edge for detachably securing to said front panel for securing the side wall panels in an upright position.

22. The multi-pocket assembly of claim 18, further comprising the combination of a removable multi-pocket assembly, the multi-pocket assembly comprising:

a generally rectangular foldable back panel having an inner surface and an outer surface, the back panel foldable along a transverse line to define an upper panel and a lower panel;

an upper pocket assembly on the inner surface of said upper panel, the upper pocket assembly including a transparent pocket;

a lower pocket assembly on the inner surface of said lower panel, the lower pocket assembly including a pleated pocket section that forms a plurality pockets having an open top being generally the same length and shaped and configured to receive articles; and a plurality of elastic retaining loops on the outer surface of said back panel; wherein said upper panel foldable over said lower panel.

* * * * *